United States Patent [19]

Minto et al.

[11] Patent Number: 4,469,734

[45] Date of Patent: Sep. 4, 1984

[54] MICROFIBRE WEB PRODUCTS

[75] Inventors: Mansoor A. Minto, Larkfield; Dennis G. Storey, Bearsted, both of England

[73] Assignee: Kimberly-Clark Limited, Kent, England

[21] Appl. No.: 570,445

[22] Filed: Jan. 16, 1984

Related U.S. Application Data

[63] Continuation of Ser. No. 444,232, Nov. 24, 1982, abandoned.

[30] Foreign Application Priority Data

Nov. 24, 1981 [GB] United Kingdom ..... 8135330

[51] Int. Cl.[3] ..... B32B 3/10

[52] U.S. Cl. ..... 428/134; 156/148; 156/252; 428/131; 428/283; 428/296; 428/300; 428/326; 428/903

[58] Field of Search ..... 428/131, 132, 134, 135, 428/296, 283, 326, 903, 300; 156/148, 252

[56] References Cited

U.S. PATENT DOCUMENTS

| | | | |
|---|---|---|---|
| 3,280,229 | 10/1966 | Simons | 428/131 |
| 3,756,907 | 9/1973 | Heling | 156/252 |
| 3,949,127 | 4/1976 | Ostermeier et al. | 428/903 |
| 3,949,130 | 4/1976 | Sabee et al. | 428/296 |
| 4,041,203 | 8/1977 | Brock et al. | 428/903 |
| 4,100,324 | 7/1978 | Anderson et al. | 428/903 |
| 4,128,679 | 12/1978 | Pohland | 156/252 |
| 4,153,664 | 5/1979 | Sabee | 264/289 |
| 4,276,336 | 6/1981 | Sabee | 428/132 |
| 4,355,066 | 10/1982 | Newman | 428/903 |

FOREIGN PATENT DOCUMENTS

| | | |
|---|---|---|
| 920848 | 3/1963 | United Kingdom . |
| 1132120 | 10/1968 | United Kingdom . |
| 1286345 | 8/1972 | United Kingdom . |
| 1308677 | 2/1973 | United Kingdom . |
| 1380613 | 1/1975 | United Kingdom . |
| 1393426 | 5/1975 | United Kingdom . |

*Primary Examiner*—James J. Bell

*Attorney, Agent, or Firm*—Fidelman, Wolffe & Waldron

[57] ABSTRACT

A non-woven web made from melt blown microfibres which is formed or provided with apertures by, for example, hot needling or by passing the web between differentially speeded rolls. If the web is used for wiping, the apertures help to retain fluid and enhance the wiping properties for oil.

10 Claims, 10 Drawing Figures

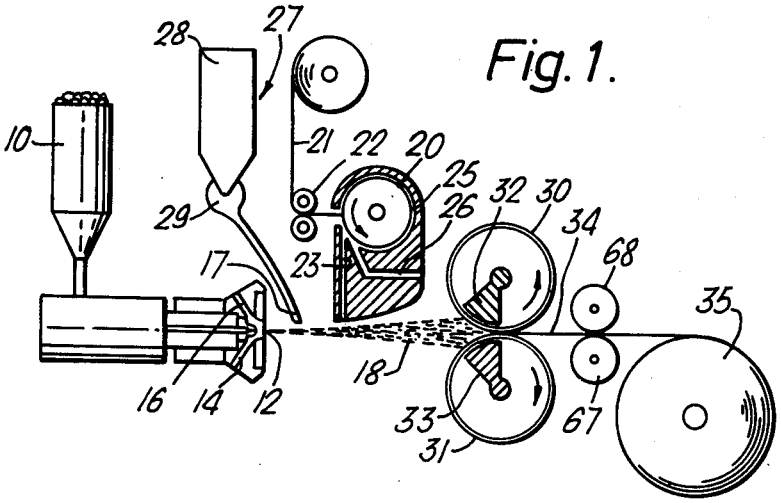
Fig. 1.
Fig. 2.
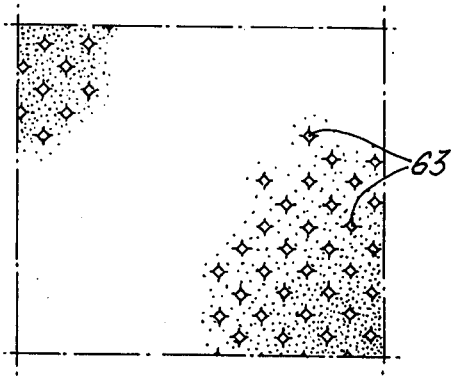
Fig. 3.
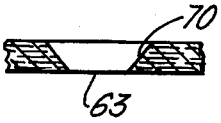

ICCL/12-80/I
face 80x
(1cm = 125pm)

ICCL/12-80/q
face 180x
(1cm = 86pm)

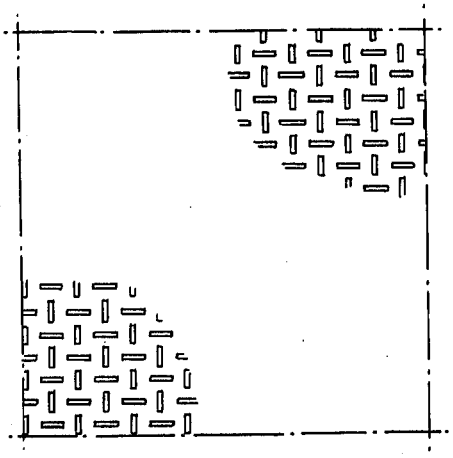
Fig. 6C.
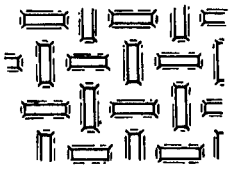
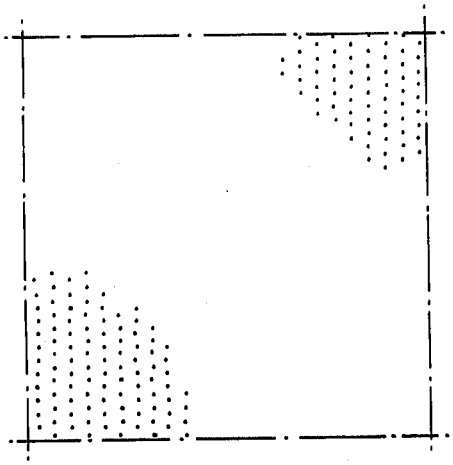
Fig. 6D.
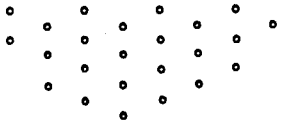

MICROFIBRE WEB PRODUCTS

This application is a continuation of application Ser. No. 444,232, filed Nov. 24, 1982 now abandoned.

The present invention relates to non-woven fabrics and to a method of producing these. Such fabrics comprise a matrix of melt blown polymer fibres.

Fabric made from melt blown polymer fibre (e.g. polyesters, polypropylene, nylons or polyethylene) is well known and is described, for exampl, in British Pat. No. 2,006,614, British Pat. No. 1,295,267 and U.S. Pat. No. 3,676,242. Such a fabric will be referred to hereafter as M.B.P.F.

Mats of melt blown polyolefin fibres have been proposed as wipers, but these are usually deficient in regard to water absorbency. It has been additionally proposed therefore in British Pat. No. 2,006,614 that the M.B.P.F. is treated with a wetting agent. Other forms of melt blown fabrics suitable for wipers have been described in British Pat. No. 1,581,486 where wood pulps or staple textile fibres are held entangled in a matrix of melt blown microfibres.

A particular characteristic of all such mats due to the small size of the microfibres which generally have an average diameter less than 10 microns, is the very high capilliary forces which exist. This results in good retention of fluids and very good wiping performance with light oils and water or oil water emulsions.

However, the high capilliary absorption of the fabrics results in a less desirable characteristic. The ability of the fabrics to retain fluid is such that they cannot easily be wrung out by hand. For many wiper applications this is a disadvantage. For example, in catering establishments when wiping table tops and counter tops or when the wiper is generally used wet, the normal practice is to soak the wiper in water before use. Its performance then depends on wringing out as much water as possible so as to be able to re-absorb liquid spills and the like. Another example, is in the printing industry where printing plates and cylinders are wiped down using wipes soaked in solvent. Again it is important for the wiper to release sufficient solvent for the job to be accomplished.

Other disadvantages of the melt blown wiper structures due to their closed structure are a reduced ability to absorb higher viscosity fluids such as heavy oils. Nor will they pick up greasy or sticky dirt or readily hold large coarse particles.

A further characteristic of existing melt blown wipers is that they are frequently bonded by a point application of heat and pressure, by means of patterned bonding rollers. At these points where heat and pressure is applied, the thermoplastic microfibres fuse together, resulting in strengthening of the web structure. However, the fusion of the fibres results in the creation of solid spots of non-absorbent thermoplastic. Not only are these spots not absorbent, but they can also act as barriers to the flow or transfer of fluid within the web. This can be particularly harmful if a line type of bonding pattern is adopted, since the lines of fused thermoplastic act as dams beyond which fluid cannot flow.

A non-woven fabric in accordance with the invention comprises melt blown thermally bonded thermoplastic microfibres formed or provided with apertures or perforations constituting between 1 and 40% preferably 1 to 30% of the area of the fabric.

This enables the wiper to release absorbed fluid very readily. The apertures themselves also provide a capability to absorb large quantities of fluid especially if it is too viscous to be taken up by the microfibre web structure; and in addition enable the wiper to take up greasy, sticky materials or dirt particles. If the structure is further modified to become sufficiently coarse, a scrubbing type of wiping action is possible. It is also easier to wring out excess water or solvent when used as a wet wiper or where solvent release is required for the wiping task.

It is desirable that the aperturing process also increases the strength of the non-woven mat, by fusing some of the fibres to create bonds between them.

A method of achieving such aperturing is described in German Pat. No. 26 14 100 wherein a gravure roll is heated to the melting temperature of the material and is run against a smooth backing roll at the softening temperature of the material and is rotated at a higher peripheral speed than the backing roll, the melt blown material being drawn through the nip between the rolls.

Alternatively, the fabric may be apertured by hot needling where the melt blown material is passed under reciprocating needles or needles on rotating rollers, the needles being heated to at least the melting temperature of the material.

In order to avoid the problems of non-absorbent fused areas it is preferred that the apertures be created within the bond areas so that the fibres are bonded for strength around the circumference of the bond area and the centre portion of the said area is apertured.

The shape of the apertures may be circular, diamond or rectangular and the apertures may be arranged in rows, circles or other patterns. The apertures/perforations will normally penetrate through the fabric.

The fibres are preferably polymeric and have a diameter between 1 and 50 microns, with most fibres preferably less than 10 microns. The fibres may be of polyester, nylon, polyethylene or polypropylene.

Other fibres such as wood pulp or staple textile fibres, e.g. cotton, polyester, rayon, may be added.

The resultant fabric may be treated with surfactants.

As described in our co-pending British Application No. 8135331, absorbent particles may be introduced into the stream of melt blown tangled fibres whilst the fibres are still tacky so that the particles are firmly attached to the fibres when these have finally set. Additive fibres such as wood pulp fibres or staple textile fibres can be added to the product substantially simultaneously with the particles and whilst the fibres are still unset so that the additive fibres and particles are adhered to the melt blown fibres on setting. A web is then consolidated from the set fibres and particles.

It has been found that the clay or other absorbent particles significantly decreases the product cost by reducing the polymer content required per weight of the product. Alternatively, particles of super absorbent material may be introduced so as to produce a web which is characterised by the presence of super absorbent particles distributed substantially individually and spaced throughout the web.

The invention will now be further described by way of example with reference to the accompanying drawings in which:

FIG. 1 is a partly schematic side elevation of an apparatus for producing fabrics according to the present invention;

FIG. 2 is a plan view of a fragment of fabric according to the present invention which has been perforated;

FIG. 3 is a cross-section of one of the perforations of the fabric of FIG. 2;

FIGS. 6A–6D are a diagram illustrating various possible shapes and arrangements of apertures.

Figure 4:
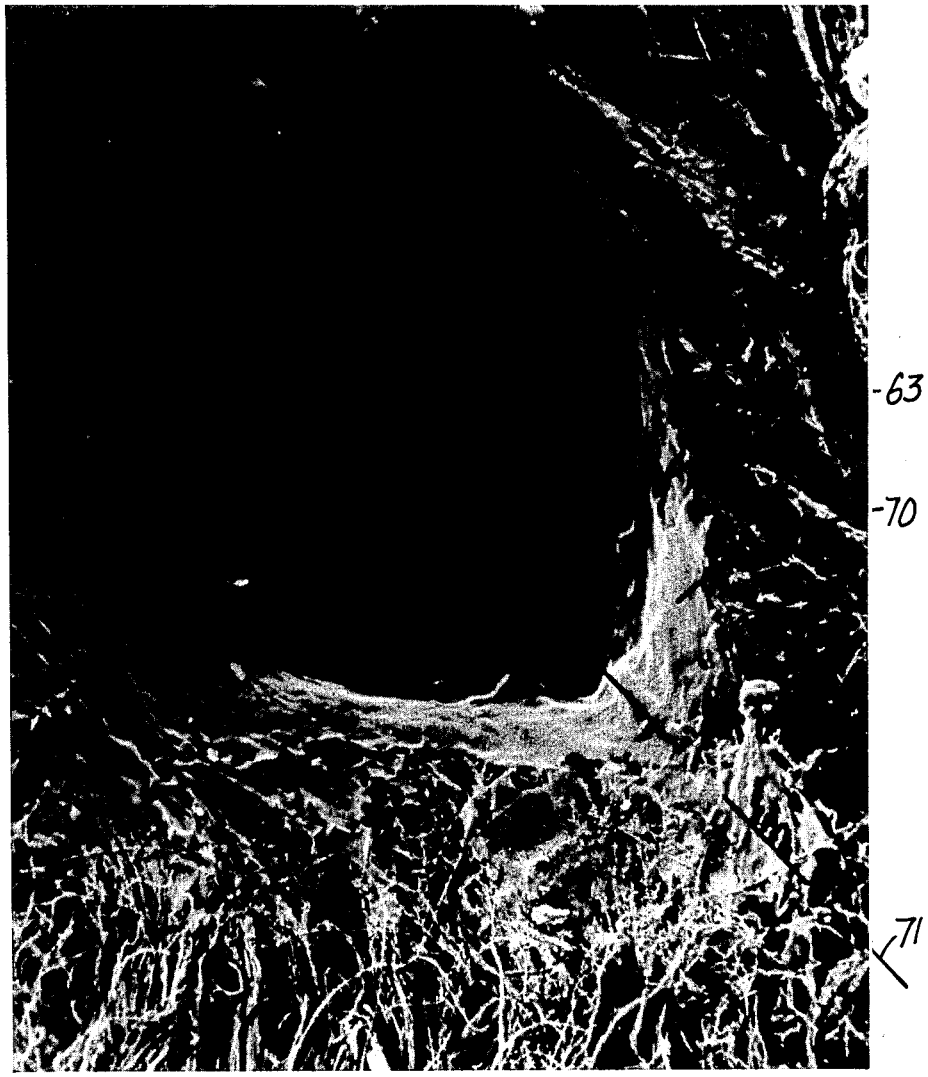
FIG. 4 is an electron microscope photograph taken on the plane of the fabric showing a perforation/bond produced by using differentially speeded rolls.

Referring to FIG. 1 a primary gas stream 18 containing discontinuous polymeric microfibres is formed by a known melt-blowing technique, such as the one described in an articles entitled "Superfine Thermoplastic Fibres" appearing in Industrial and Engineering Chemistry, Vol. 48, No. 8, pp 1342 to 1346 which describes work done at the Naval Research Laboratories in Washington, D.C. Also see Naval Research Laboratory Report No. 11437 dated Apr. 15, 1954, U.S. Pat. No. 3,676,242 and U.S. Pat. No. 4,100,324 issued to Anderson et al.

The apparatus shown in FIG. 1 is generally the same as described in U.S. Pat. No. 4,100,324 with the exception of two particular features which will be described hereinafter and the subject matter of that patent is to be considered as being included in the present specification and will not be further described. The subject matter of U.S. Pat. No. 3,793,678 entitled "Pulp Picking Apparatus with Improved Fibre Forming Duct" is also to be considered as being included in the present specification insofar as the picker roll 20 and feed 21 to 26 are concerned, is also described in U.S. Pat. No. 4,100,324.

Discontinuous thermoplastic polymeric material from a hopper 10 is heated and then caused to flow through nozzle 12 whilst being subjected to air jets through nozzles 14, 16 which produces a final stream 18 containing discontinuous microfibres of the polymeric material. This is known as melt-blowing.

The picker roll 20 and associated feed 21 to 26 are an optional feature of the apparatus of FIG. 1 and are provided to enable the introduction of fibrous material into the web of the invention if this is required.

The picker device comprises a conventional picker roll 20 having picking teeth for divellicating pulp sheets 21 into individual fibres. The pulp sheets 21 are fed radially, i.e., along a picker roll radius, to the picker roll 20 by means of rolls 22. As the teeth on the picker roll 20 divellicate the pulp sheets 21 into individual fibres, the resulting separated fibres are conveyed downwardly toward the primary air stream through a forming nozzle or duct 23. A housing 24 encloses the picker roll 20 and provides a passage 25 between the housing 24 and the picker roll surface. Process air is supplied to the picker roll in the passage 25 via duct 26 in sufficient quantity to serve as a medium for conveying the fibres through the forming duct 23 at a velocity approaching that of the picker teeth. The air may be supplied by any conventional means as, for example, a blower.

It has been found that, in order to avoid fibre floccing, the individual fibres should be conveyed through the duct 23 at substantially the same velocity at which they leave the picker teeth after separation from the pulp sheets 21, i.e., the fibres should maintain their velocity in both magnitude and direction from the point where they leave the picker teeth. More particularly, the velocity of the fibres separated from the pulp sheets 21 preferably does not change by more than about 20% in the duct 23. This is in contrast with other forming apparatus in which, due to flow separation, fibres do not travel in an ordered manner from the picker and, consequently, fibre velocities change as much as 100% or more during conveyance.

Further details of the picker device may be found in U.S. Pat. No. 4,100,324. The particular differences between the apparatus shown in FIG. 1 of the present specification and that of FIG. 1 of U.S. Pat. No. 4,100,324 is the means 27 for introducing particulate absorbent material into the melt blown fibre stream 18. The particle introduction means comprises a hopper 27 and air impeller 29 so arranged that the particles are ejected as a stream through a nozzle 17 into the fibre mat shortly after the nozzle 12 and whilst the melt blown fibres remain unset and tacky. The particles stick to the tacky fibres and are distributed throughout the fibre mat.

The fibres then cool as they continue in their path and/or they may be quenched with an air or water jet to aid cooling so that the fibres are set, with the particles adhered to them, before the fibres are formed into a web as described hereafter.

It is also possible to introduce the absorbent particles through the picker roll 20 and nozzle 23 either as an independent stream of particles or together with a stream of wood pulp fibres or a stream of staple textile fibres.

The hot air forming the melt blown fibres is at similar pressures and temperatures to that disclosed in U.S. Pat. No. 4,100,324.

The set fibres and particles are condensed into a web by passing the mat of fibres between rolls 30 and 31 having foraminous surfaces that rotate continuously over a pair of fixed vacuum nozzles 32 and 33. As the integrated stream 18 enters the nip of the rolls 30 and 31, the carrying gas is sucked into the two vacuum nozzles 32 and 33 while the fibre blend is supported and slightly compressed by the opposed surfaces of the two rolls 30 and 31. This forms an integrated, self-supporting fibrous web 34 that has sufficient integrity to permit it to be withdrawn from the vacuum roll nip and conveyed to a wind-up roll 35.

The web is then passed into the nip between heated rolls 67 and 68 which are differently speeded rolls and which may or may not be driven separately depending on their relative diameters and the requirement to adjust differential speeds with a speed differential of up to 50% of the roll periphery or the fabric engaging surfaces.

In this case one of the rolls 67, 68 is engraved with a pattern of raised points and is set against a smooth surface backing roll. The engraved roll is heated to a sufficiently high temperature for the thermoplastic web to begin to melt at the tips of the raised points, and the backing roll is heated to a slightly lower temperature equivalent to the softening temperature of the material. The peripheral speed of the gravure roll may be varied up to as much as twice that of the smooth backing roll. The diameter of the rolls is suitably between 350 and 400 mm. The rolls act both to bond fibres together at the raised points and because of the differential speed the web is torn or apertured, the apertures normally occurring within the bond area.

The embossments on the roll may extend further from the roll surface than the thickness of the web which also aids in achieving an enhanced web product.

Figure 7:
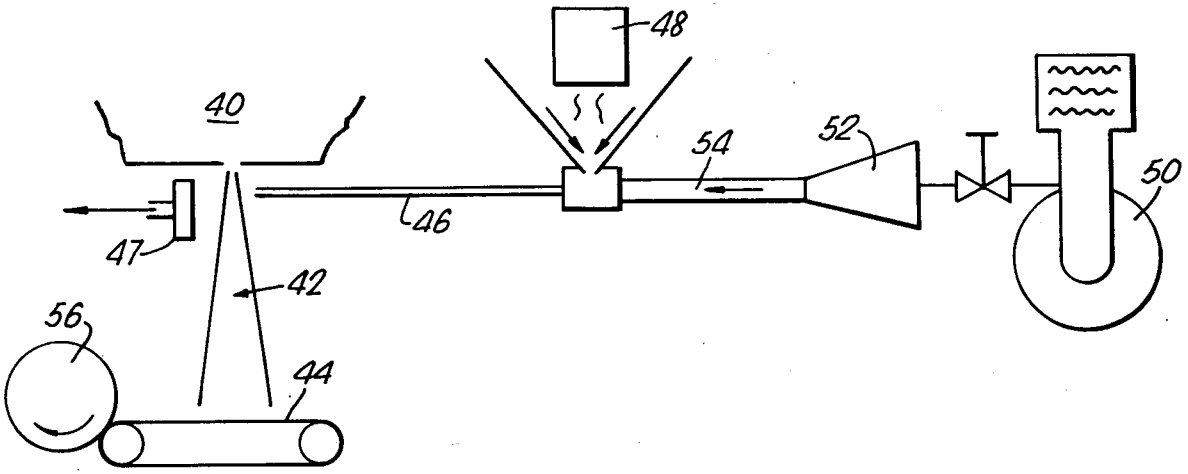
FIG. 7 is a diagrammatic illustration of an alternative apparatus for producing webs in accordance with the invention.

An alternative apparatus for use in producing a web in accordance with the invention and which is particularly suitable for the production of a web having particles of super absorbent material therein, is illustrated in FIG. 7.

The melt blown fibres are produced by a device similar to that illustrated in FIG. 1 and which is diagrammatically shown at 40 in FIG. 7. The stream 42 of fibres passes downwardly towards a screen collector 44 on which the fibres are consolidated into a web.

Particles of super absorbent material are blown onto the mat of melt blown fibres through a nozzle 46 shortly after the fibres leave the outlet nozzle of the melt blown extruder apparatus 40. The air stream has a velocity of about 6,000 feet per minute and dust is caught by a dust catcher 47.

The particulate super absorbent material is held in a particle dispenser 48 which may be that known as Model 500 made by the Oxi-Dry Corporation of Roselle, N.J., and is metered into an air stream formed by an air blower 50 passing through an air diffuser 52 and an air straightener 54. The powder in the dispenser is fed using an engraved metal roll in contact with two flexible blades. The cavity volume of the roll, roll speed and particle size control feed rate. An electrostatic charge is desirably applied to the particles to promote individual particle separation in the composite, as gravity drops the particles into the air stream.

High turbulence at the conversion of the separate air streams, one containing fibre and the other particulate super absorbent, results in thorough mixing and a high capture percentage of the particulates by the microfibre. The particles are thus distributed substantially individually and spaced throughout the web formed from the fibre/particle mix by collecting it on the moving screen 44. It is then wound, as a non-woven fabric, onto a roll 56.

In an alternative arrangement one of the rolls 67, 68 is provided with heated needles and the other is smooth and resilient.

FIGS. 2 and 3 show an example of a web which has been found with apertures 63.

Figure 5:
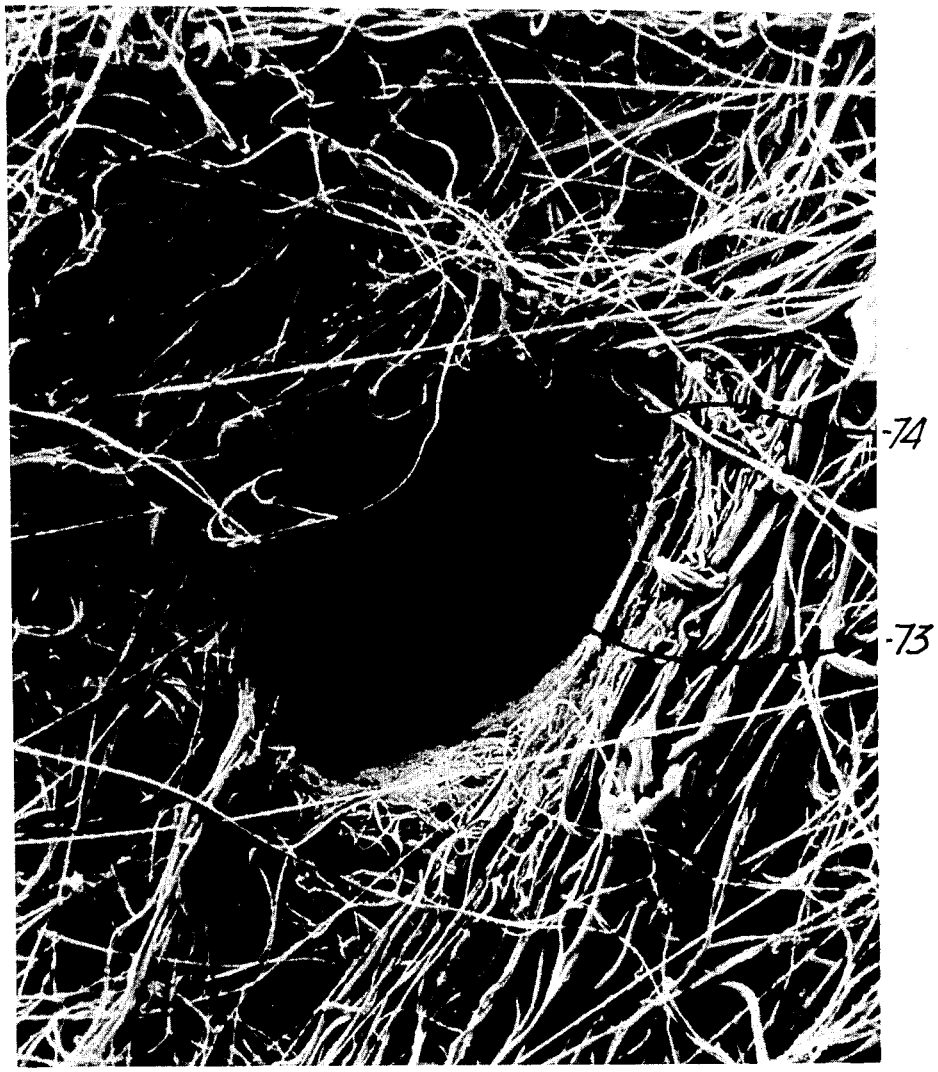
FIG. 5 is a similar electron microscope photograph showing perforations/bonds produced by hot needling.

FIG. 4 is an electron microscope photograph of the web of FIG. 2 perforated by calendering with differential speeded heated rolls. In FIG. 4 the sides of the perforated hole 63 particular at 70 along the rolling axis 71 can be seen to be fused. This produces a strongly bonded fabric. In the web shown in FIG. 5 where the hole 63 has been formed by hot needling, the sides 74 are generally much less fused and this leads to a weaker but softer and bulkier fabric.

The following comparison tests in Table 1 were conducted between standard M.B.P.F. treated to perforation as shown in FIG. 2 and embossed calendered non-perforated material.

TABLE 1

| | Perforated | Embossed |
|---|---|---|
| Basis wt g/m$^2$ | 91 | 85 |
| Thickness (microns) | 770 | 553 |
| Tensile Strength gm | 1345 | 1010 |
| Fluid Holding Capacity for oil (SAE 10) | | |
| (i) at atmospheric pressure gm/gm | 10.43 | 6.10 |
| (II) at 0.28 kg/cm$^2$ | 10.00 | 1.76 |
| (iii) at 0.42 kg/cm$^2$ | 9.13 | 0.23 |

The differential speed of the rolls causes the relatively outer fibres to be in effect lifted or "brushed up" giving an enhanced thickness to the web as is evidenced in the increase in thickness of from 553 to 770 microns in the test illustrated above. The limiting factor for the increase is the depth of pattern on the engraved roll.

It is evident that the treatment by rolls 67 and 68 according to the invention greatly improves the performance of the fabric.

Examples of the shape and arrangement of apertures is illustrated in FIG. 6.

Figure 6A:
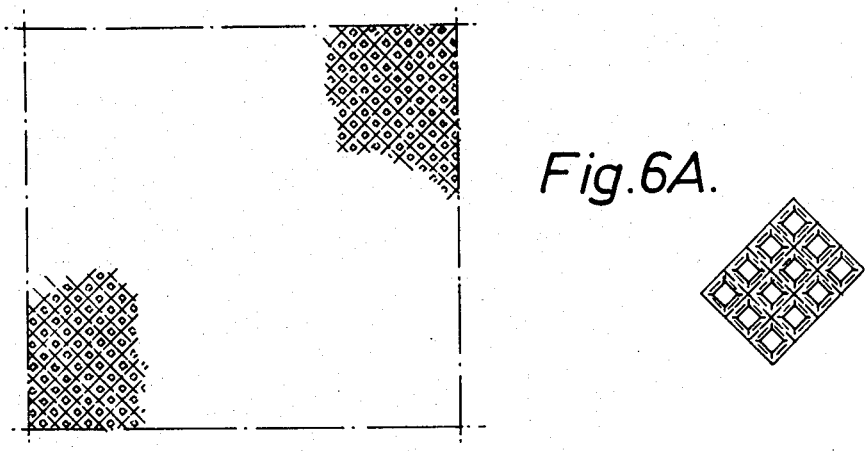
Figure 6B:
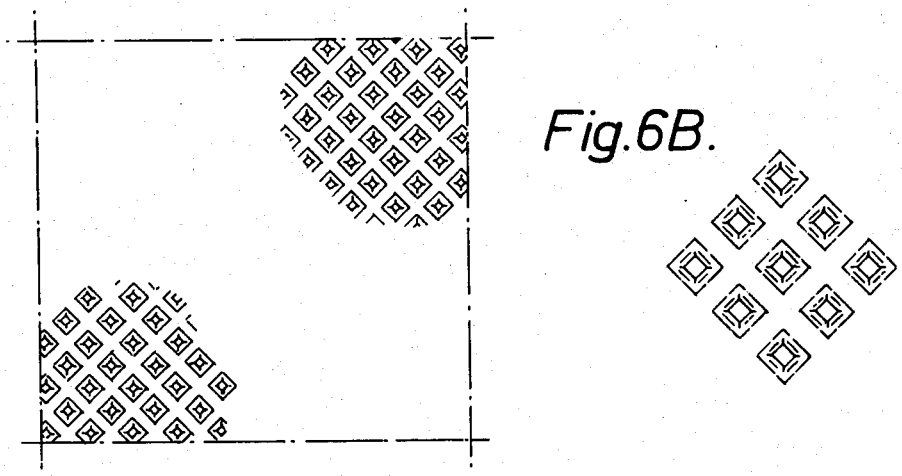

The diamond shaped apertures shown in FIGS. 6A and 6B are arranged in rows and the area of the aperture may be between 0.4 mm$^2$ and 1.37 mm occupying a percentage area of the fabric of 12.5 and 10 respectively. If the shape of the aperture is rectangular as shown in FIG. 6C with the rectangles extending alternately up and across the fabric the area of each aperture may be 2.8 mm and occupy an area of 30% of the fabric. In this case the aperture/perforation may not extend completely through the fabric.

FIG. 6D is an example of a hot needle perforated web. The area of each needle hole is 0.015 mm$^2$ and the holes occupy an area of about 1% of the fabric.

We claim:

1. A nonwoven fabric consisting of a web comprising meltblown thermoplastic microfibers and including thermal bond areas formed or provided with apertures penetrating through the fabric within substantially all of the thermal bond areas wherein the fibers are bonded together around the circumference of the bond areas, said apertures constituting between 1 and 40% of the surface area of the fabric.

2. A nonwoven fabric consisting of a web comprising meltblown thermoplastic microfibers and including thermal bond areas formed or provided with apertures in substantially all of said bond areas, said apertures having a circular, diamond or rectangular shape and constituting between 1 and 40% of the area of the fabric and wherein the fibers are bonded together around the circumference of the apertures.

3. A nonwoven fabric as claimed in claims 1 or 2 in which the apertures are arranged in rows, circles or other patterns.

4. A nonwoven fabric as claimed in claim 3 in which most fibers have a diameter of less than 10 microns.

5. A nonwoven fabric as claimed in claim 4 having absorbent particles distributed throughout the web and held by adherence to the meltblown fibers.

6. A nonwoven fabric as claimed in claim 5 having superabsorbent particles distributed substantially individually and spaced throughout the web.

7. A nonwoven fabric as claimed in claim 6 including woodpulp or textile fibers.

8. A method of making a nonwoven fabric consisting of a web comprising meltblown fibers comprising the steps of, extruding a molten polymeric material producing a stream of meltblown polymeric microfibers;

cooling the fibers or allowing them to cool;

forming or consolidating said fibers into a fabric;

forming thermal bond areas in said fabric; aperturing said fabric providing apertures penetrating through the fabric in substantially of all said bond areas, said apertures constituting from 1 to 40% of the area of said fabric and being surrounded by fused fibers.

9. A method as claimed in claim 8 in which the apertures are formed by passing a fabric between a gravure roll heated to at least the melting point of the material of the fibers and a smooth backing roll, the gravure roll being rotated at a higher speed than the backing roll.

10. A method as claimed in claim 9 in which the apertures are formed by a reciprocating needle or needles on a rotating roll, the needles being heated to at least the melting point of the fiber material.

* * * * *